US005709441A

United States Patent [19]

Bartling et al.

[11] Patent Number: 5,709,441

[45] Date of Patent: Jan. 20, 1998

[54] CREMATION URN DISPLAY PEDESTAL

[75] Inventors: Bart Bartling, Batesville; John R. Enneking, Batesville; Daniel J. Parker, Connersville, all of Ind.

[73] Assignee: Batesville Casket Company, Inc., Batesville, Ind.

[21] Appl. No.: 643,544

[22] Filed: May 6, 1996

[51] Int. Cl.[6] ..... A47B 87/00

[52] U.S. Cl. ..... 312/107; 312/111; 312/223.5; 108/180

[58] Field of Search ..... 312/107, 108, 312/111, 238, 263, 265.5, 265.6, 351, 223.5, 114, 223.6; 108/91, 101, 153, 23, 92, 180; D6/449, 474; 362/127, 133; 211/186, 188

[56] References Cited

U.S. PATENT DOCUMENTS

| | | | |
|---|---|---|---|
| D. 143,426 | 1/1946 | Karp . | |
| D. 167,573 | 8/1952 | Johnson | D6/474 |
| D. 275,057 | 8/1984 | Freedenberg . | |
| D. 321,037 | 10/1991 | Furusawa . | |
| 321,037 | 6/1885 | Kinley . | |
| D. 374,573 | 10/1996 | Brunner et al. . | |
| 1,834,955 | 12/1931 | Leigh | 108/101 |
| 2,368,285 | 1/1945 | Bullard | 312/238 |
| 2,526,246 | 10/1950 | Leeper | 211/188 X |
| 3,406,645 | 10/1968 | Monroe | 108/23 |
| 3,644,008 | 2/1972 | Overby | 312/257.1 X |
| 4,633,788 | 1/1987 | Robertson | 108/180 X |
| 4,911,311 | 3/1990 | Nagai | 211/188 X |
| 5,054,863 | 10/1991 | Amstutz et al. | 312/108 X |

FOREIGN PATENT DOCUMENTS

| | | | |
|---|---|---|---|
| 705806 | 3/1965 | Canada | 312/111 |
| 7908490 | 6/1980 | Netherlands | 312/111 |

OTHER PUBLICATIONS

Color Reproduction of "Pedestals" Lithograph Options By Batesville ©1995.

*Primary Examiner*—Peter M. Cuomo
*Assistant Examiner*—Janet M. Wilkens
*Attorney, Agent, or Firm*—Wood, Herron, & Evans

[57] ABSTRACT

A decorative cremation urn display pedestal comprises a lower base configured into a generally box-like structure and including four generally vertical side walls having abutting adjacent side edges, and a generally horizontal cremation urn-supporting top wall supported atop the side walls. A pair of shelf-supporting walls extend upwardly from the top wall and have abutting adjacent side edges, with each wall of the pair being generally parallel to a respective base side wall thereunder. At least one generally horizontal cremation urn-supporting shelf extends horizontally outward from the pair of shelf-supporting walls. The shelf corresponds in size and shape to the base top wall and is cantilevered horizontally outward from the pair of shelf-supporting walls by having a free unsupported corner positioned above a respective corner of the base top wall.

21 Claims, 2 Drawing Sheets

CREMATION URN DISPLAY PEDESTAL

FIELD OF THE INVENTION

This invention relates generally to merchandising, and more specifically to merchandising or display of funeral products such as cremation urns for viewing and selection by customers of a funeral home.

BACKGROUND OF THE INVENTION

Cremation is a growing segment of the funeral products and services industry. Some studies are predicting that by the turn of the century cremation will comprise 30% of the market. The growing demand for the service of cremation simultaneously drives the demand for expanding product lines associated with cremation, for example for new and original cremation urn designs and the like.

Expanding cremation product lines and the desire of funeral customers to be able to conveniently examine the cremation products offered by a funeral home for selection thereof necessitates the need for some type of merchandising or display means for showcasing and offering for sale to those customers the products offered by the funeral home. One type of display which the assignee of the present invention has heretofore employed has been a so-called cremation urn display pedestal. A cremation urn display typically comprises five such pedestals, with each pedestal being of a different height. The pedestals vary in height from 54 inches, to 48 inches, to 36 inches, to 24 inches and finally down to 18 inches. The pedestals are arranged generally so that the tallest pedestal is in the rear of the display, with ever shorter pedestals being positioned progressively toward the front of the display. Each display pedestal is square in cross-section having a top cremation urn-supporting surface of about 12 inches by 12 inches.

While successful, such cremation urn displays made up of these types of pedestals nonetheless have some disadvantages. First, the taller ones of the display pedestals can tend to become somewhat unstable once a weighty cremation urn is placed atop the pedestal. Second, only a relatively few cremation urns can be displayed with such a display, for example, only 5 urns in 5 square feet (1 urn per 1 foot square pedestal).

Other types of display structures have also been utilized to display for selection cremation urns in funeral homes. For example, display cabinets resembling so-called "china cabinets" or "curio cabinets" have been utilized to display cremation urns. Such a cabinet is generally an upright structure having openable, sometimes glass, doors and a number of vertically spaced, often glass, shelves for supporting urns thereon. Some provision for lighting may be included in the cabinet for example in the roof of the cabinet. However such display cabinets are generally expensive and can be subject to becoming damaged, for example the glass doors or shelves can become broken.

Another technique for displaying cremation urns in funeral homes is with the use of built-in shelving in the selection room. As with china or curio type cabinets, however, this type of built-in shelving can be expensive and it of course requires wall space which could be put to other, more productive use were the built-in shelving not attached to it.

It is therefore a main objective of the present invention to provide an improved means of displaying cremation urns to present the urns to customers of the funeral home for selection yet without the attendant disadvantages of the prior employed techniques.

SUMMARY OF THE INVENTION

In accordance with the stated objective, the present invention is a decorative cremation urn display pedestal. The pedestal comprises a lower base configured into a generally box-like structure and including four generally vertical side walls having abutting adjacent side edges, and a generally horizontal cremation urn-supporting top wall supported atop the side walls. A pair of shelf-supporting walls extend upwardly from the top wall and have abutting adjacent side edges, with each wall of the pair being generally parallel to a respective base side wall thereunder. At least one generally horizontal cremation urn-supporting shelf extends horizontally outward from the pair of shelf-supporting walls. The shelf corresponds in size and shape to the base top wall and is cantilevered horizontally outward from the pair of shelf-supporting walls by having a free unsupported corner positioned above a respective corner of the base top wall.

The shelf-supporting walls are preferably recessed inwardly slightly relative to the base top wall and the urn-supporting shelf, and the urn-supporting shelf is preferably supported atop the upper edges of the shelf-supporting walls. In one embodiment the pedestal has a pair of shelf-supporting walls and a single urn-supporting shelf, while in another embodiment the pedestal has two vertically spaced pairs of shelf-supporting walls and a vertically spaced pair of urn-supporting shelves.

The shelf of the cremation urn display pedestal of the present invention may further include a light mounted centrally on the lower surface of the urn-supporting shelf to provide illumination to the urn situated therebelow on the top wall of the base. The shelf further preferably includes a side edge opposite each shelf-supporting wall, with each side edge having a lip extending downwardly therefrom. These lips conceal the light mounted underneath the urn-supporting shelf when the display pedestal is normally viewed by an observer. The pedestal may yet further include a dimmer switch in electrical communication between the light and a source of electrical current which is operable to selectively brighten and dim the light as desired.

The walls and the shelf of the pedestal of the present invention are preferably fabricated from pressed wood particle board. The exterior visible surfaces of the walls and shelf are preferably laminated with decorative vinyl sheet.

The top wall and shelf are preferably square and are preferably approximately 16 inches on a side. The upper surface of the top wall of the base is preferably approximately 24 inches above a supporting floor surface, the upper surface of the urn-supporting shelf is preferably approximately 40 inches above a supporting floor surface, and in the embodiment having two such urn-supporting shelves the second shelf is preferably approximately 55 inches above a supporting floor surface.

The walls and shelf of the pedestal are secured together with the use of hot-melt glue. Additionally, the base top wall is secured to the upper edges of the base side walls with the use of dowels. Similarly, the urn-supporting shelf is additionally secured to the shelf-supporting walls with the use of dowels.

In another aspect of the present invention, a cremation urn display in a funeral home display area for offering for sale cremation urns to customers of the funeral home is provided. The display comprises a pedestal of the type described above and a pair of cremation urns, one of which is supported atop the top wall and the other of which is supported atop the shelf. The display may alternatively include a two shelf pedestal of the type described above, supporting a total of three cremation urns, and further include two additional single-shelf display pedestals one of which is located on either side of the two-shelf pedestal and each supporting two cremation urns for a total of seven cremation urns in the display. Finally, the display may further comprise a pair of box-like pedestals one of which is positioned forward of each single-shelf pedestal and each of which comprises four generally vertical side walls having abutting adjacent edges and a generally horizontal cremation urn-supporting top wall supported atop the side walls, and each of which has a cremation urn supported on its respective top wall, for a total of nine cremation urns in the display.

In yet another aspect of the present invention, a decorative cremation urn display pedestal is provided which comprises a lower base including a pair of generally vertical side walls having abutting adjacent side edges and a generally horizontal cremation urn-supporting top wall supported atop the side walls. A pair of shelf-supporting walls extend upwardly from the top wall and have abutting adjacent side edges with each wall of the pair being generally parallel to a respective base side wall thereunder. At least one generally horizontal cremation urn-supporting shelf extends horizontally outward from the pair of shelf-supporting walls. The shelf is cantilevered horizontally outward from the pair of shelf-supporting walls by having a free unsupported portion positioned above a respective portion of the base top wall. While in the preferred embodiment the base top wall and urn-supporting wall are square, it is contemplated that this aspect of the invention encompasses other shapes of the cantilevered portion of the urn-supporting wall, for example rounded or semi-circular.

One advantage of the present invention is that an urn display pedestal is provided which can display more urns per square foot than prior single urn display pedestals. The one shelf pedestal of the present invention can display 2 urns per 1.78 square feet or 1.13 urns per square foot, and the two shelf pedestal of the present invention can display 3 urns per 1.78 square feet or 1.69 urns per square foot.

Another advantage of the present invention is that a more stable urn pedestal is provided at 16 inches per side as compared to the prior pedestal at 12 inches per side.

Yet another advantage of the present invention is that an attractive cremation urn display pedestal is provided in that the cantilevered shelves present an ornamentally distinct platform on which to display and showcase a cremation urn.

Still another advantage of the present invention is that illumination is provided for illuminating the lowermost ones of the urns on the pedestal but the source of which is generally hidden from view of an observer of the display pedestal.

These and other objects and advantages of the present invention will become more readily apparent during the following detailed description taken in conjunction with the drawings herein, in which:

DETAILED DESCRIPTION OF THE INVENTION

Figure 1:
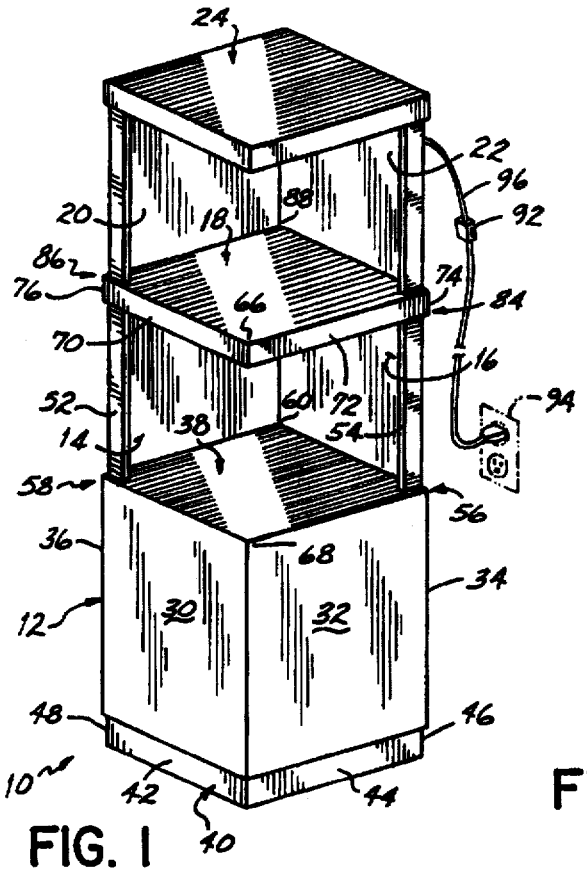
FIG. 1 is a perspective view of the cremation urn display pedestal of the present invention.
Figure 2:
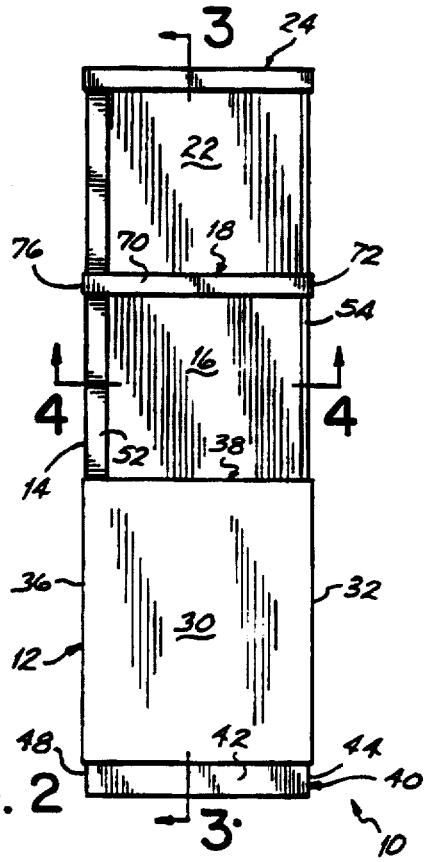
FIG. 2 is a front elevational view of the cremation urn display pedestal of FIG. 1.

Referring first to FIG. 1, there is illustrated a cremation urn display pedestal 10 according to the principles of the present invention. In the embodiment illustrated in FIG. 1, the pedestal 10 includes a lower base 12, a first pair of shelf-supporting walls 14, 16, a first cremation urn supporting shelf 18, a second pair of shelf-supporting walls 20, 22 and a second cremation urn-supporting shelf 24.

Figure 3:
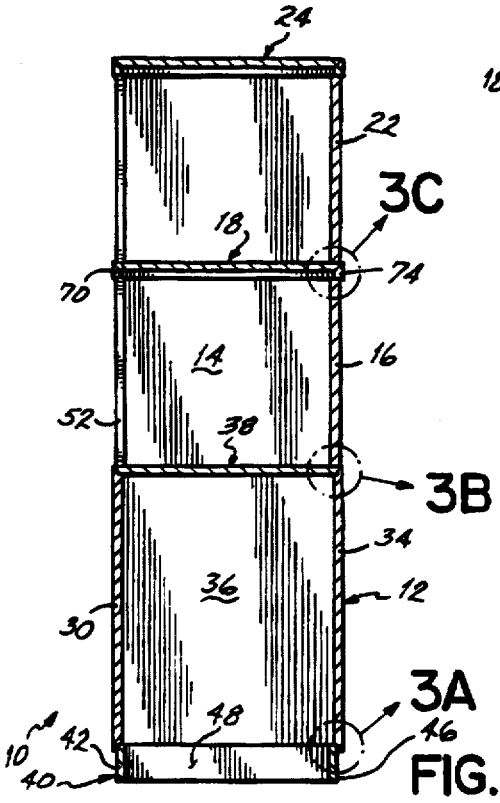
FIG. 3 is a view taken along line 3—3 of FIG. 2.
Figure 3C:
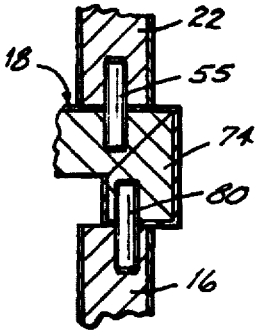
FIG. 3C is the encircled area 3C of FIG. 3 enlarged.
Figure 3B:
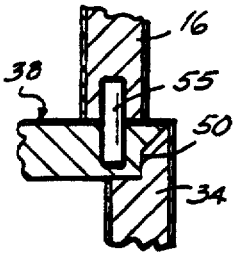
FIG. 3B is the encircled area 3B of FIG. 3 enlarged.
Figure 3A:
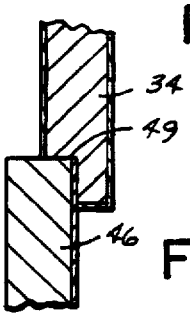
FIG. 3A is the encircled area 3A of FIG. 3 enlarged.

Describing the display pedestal 10 now in more detail, and referring now to FIGS. 1–4A, the base 12 is configured into a generally box-like structure and includes four generally vertical side walls 30, 32, 34 and 36 having abutting adjacent side edges, and a generally horizontal cremation urn-supporting top wall 38 supported atop the side walls. In addition, the base 12 may further include a recessed, short pedestal portion 40 comprised of four side walls 42, 44, 46 and 48. The side walls of this short pedestal portion 40 are recessed inwardly with respect to the side walls 30, 32, 34 and 36 of the base 12 as is seen in FIG. 3A, by about 0.312 inches. The lower edges of the base side walls 30, 32, 34 and 36 include a relief or notch 49 for accepting the upper edges of the walls 42, 44, 46 and 48 thus providing a lapped joint. As shown in FIG. 3B, the base top wall 38 is secured to the base side walls 30, 32, 34 and 36 via the use of a combination lapped/mitre joint as shown at 50.

Each of the pair of shelf-supporting walls 14 and 16 includes a flange or lip 52, 54 respectively thereon. As is seen in FIG. 3B, the side walls 14 and 16 are recessed inwardly relative to the base side walls 30, 32, 34, 36 by about 0.250 inches, to visually complement the recessed structure 40. To aid in securing the side walls 14, 16 to the base 12, dowels 55 are inserted into cooperating holes in the lower edges of the walls 14 and 16 and the top wall 38 of the base 12. Preferrably one dowel is utilized at each corner 56, 58, whereas two dowels are utilized at the corner 60.

The cremation urn-supporting shelf 18 extends horizontally outward from the pair of shelf-supporting walls 14, 16, and, in the embodiment illustrated, corresponds in size and shape to the base top wall 38. The shelf 18 is cantilevered horizontally outward from the pair of shelf-supporting walls 14 and 16 in that it has a free unsupported corner 66 positioned above a respective corner 68 of the base top wall 38. Such a cantilevered construction presents an ornamentally distinct platform on which to showcase a cremation urn. The shelf 18 further includes depending lips or flanges 70, 72, 74 and 76, for a purpose which will be subsequently described. Dowels 80 are likewise employed to secure the shelf 18 to the walls 14 and 16, with one dowel being employed at each of the corners 84, 86 and two dowels being employed at the corner 88. Walls 20 and 22, and top shelf 24, are of the same general construction as the walls 14, 16 and shelf 18, respectively, and therefore are not described in any more detail.

Figure 4:
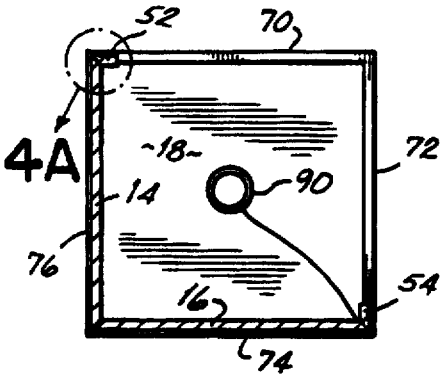
FIG. 4 is a view taken along line 4—4 of FIG. 2.

Referring now to FIG. 4, a light 90 is shown secured to the bottom surface of shelf 18. Light 90 may include a dimmer switch 92 (FIG. 1) in electrical communication between the light 90 and a source of electrical current, for example wall outlet 94 (FIG. 1), to selectively brighten and dim the light 90. The light 90 is for illuminating an urn therebelow, or on the top wall 38 of base 12. Upper shelf 24 similarly preferrably includes a light 90 mounted on its underneath surface thereof. While dimmer switch 92 is shown wired into a power cord 96 between the light 90 and outlet 94, it will be appreciated that the dimmer switch could be incorporated into the funeral home's wall mounted light dimming system. The flanges 70, 72, 74 and 76 conceal the light 90 from view as an onlooker normally views the display pedestal 10.

Figure 4A:
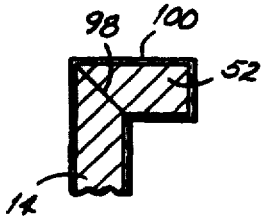
FIG. 4A is the encircled area 4A of FIG. 4 enlarged.

FIG. 4A illustrates a typical joint 98 utilized in the construction of the base 12, walls 14, 16, 20 and 22, shelves 18, 24 and pedestal 40. For example, the walls 14, 16 with flanges 52 and 54, respectively start out as a single piece of pressed wood particle board to which is laminated decorative vinyl sheet 100. Grooves are then routed or otherwise cut into the board corresponding to each mitre joint such as that shown at 98. Cold glue is then applied into each joint, and the board is simply folded into its configuration, for example the configuration of walls 14, 16 with flanges 52 and 54. Hot melt glue is then applied to the structure to hold it in place for the cold glue to set up. Similar construction techniques are utilized throughout the pedestal 10. Further, glue may additionally be used to attach the walls 14, 16 to top wall 38, shelf 18 to walls 14, 16, walls 20, 22 to shelf 18 and shelf 24 to walls 20, 22, to supplement the dowels 55 and 80.

Figure 5:
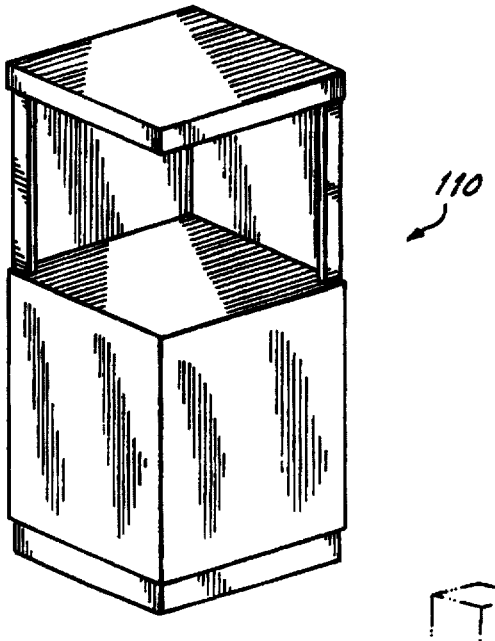
FIG. 5 is a perspective view of alternative embodiment of cremation urn display pedestal of the present invention.

Referring now to FIG. 5, there is illustrated an alternative embodiment of the cremation urn display pedestal of the present invention 110. This embodiment is identical to that shown in FIG. 1, except that the upper shelf and shelf-supporting walls have been eliminated.

Figure 6:
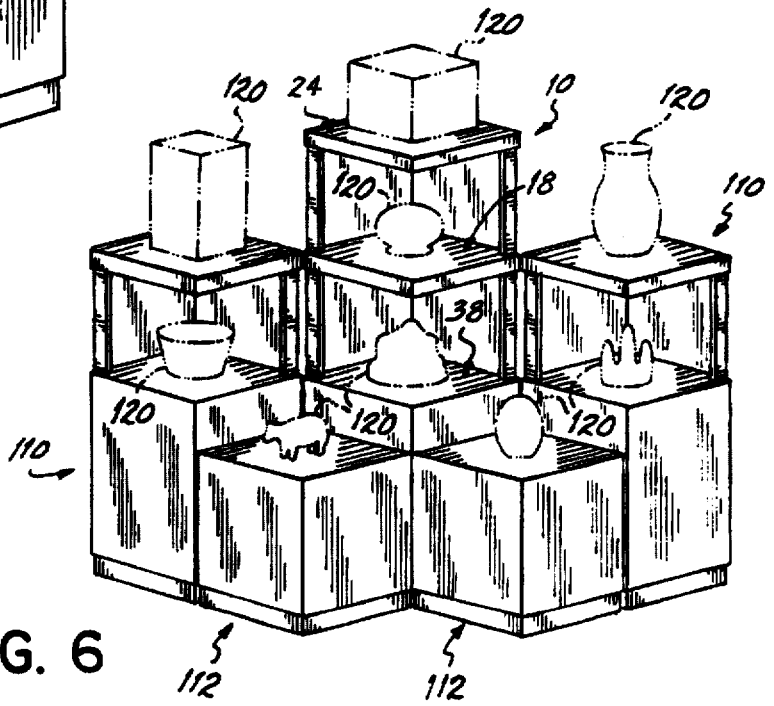
FIG. 6 is a perspective view of a cremation urn display comprised of several pedestals of the present invention supported cremation urns.

Referring now to FIG. 6, there is illustrated a preferred form of a cremation urn display including one two-shelf urn display pedestal 10, two one-shelf urn display pedestals 110 positioned on either side of the two-shelf display pedestal 10, and two generally box-like cremation urn display pedestals 112 one of which is positioned forward of each single shelf display pedestal 110, 110. The boxlike pedestals 112 are generally of the same construction as the base 12 of the pedestals 10 and 110, but are slightly shorter. As is seen in the Figure, an attractive display of nine cremation urns 120 may be provided.

While any number of dimensions may be selected for the cremation urn display pedestal of the present invention, the preferred construction is that it be square and approximately 16 inches on a side. This provides greater stability than prior pedestals, and greater urn display area. The top wall 38 of the pedestals 10 and 110 is approximately 24 inches above a supporting floor surface, the shelf 18 is approximately 40 inches above the supporting floor surface and the shelf 24 is approximately 55 inches above the supporting floor surface. While prior single urn pedestals had the capability of displaying only one urn per one square foot, the single shelf display pedestal of the present invention can display 1.13 urns per square foot and the two shelf pedestal can display 1.69 urns per square foot.

In use, the display pedestals of the present invention are positioned in a funeral home selection area and cremation urns are displayed on the shelves and base top walls. The lights may be adjusted so as to properly illuminate the urns thereon. In addition, either the single shelf display pedestal or the double shelf display pedestal is appropriate for display in the home of a surviving member of a deceased.

Those skilled in the art will readily recognize numerous adaptations and modifications which can be made to the present invention which will result in an improved cremation urn display pedestal, yet all of which will fall within the spirit and scope of the present invention as defined in the following claims. For example, it is contemplated that the invention encompass other shapes or configurations other than square for the base and shelves. For example, the cantilevered portion of the shelves could be rounded or semi-circular. Further, the shelves could be sized so as to become increasingly smaller from the bottom of the pedestal to the top to present a tiered effect. Accordingly, the invention is to be limited only by the scope of the following claims and their equivalents.

What is claimed is:

1. A decorative cremation urn display pedestal comprising:

a lower base configured into a generally box-like structure and including four generally vertical side walls having abutting adjacent side edges, and a generally horizontal cremation urn-supporting top wall supported atop said side walls;

a pair of shelf-supports walls extending upwardly from said top wall and having abutting adjacent side edges, each wall of said pair of self-supporting walls being generally parallel to a respective base side wall thereunder; and at least one generally horizontal cremation urn-supporting shelf extending horizontally outward from said pair of shelf-supporting walls, said at least one shelf corresponding in size and shape to said base top wall and being cantilevered horizontally outward from said pair of shelf-supporting walls by having a free unsupported corner positioned above and vertically aligned with a respective corner of said base top wall.

2. The cremation urn display pedestal of claim 1 wherein said shelf-supporting walls are recessed inwardly slightly relative to said base top wall and urn-supporting shelf and wherein said urn-supporting shelf is supported atop the upper edges of said shelf-supporting walls.

3. The cremation urn display pedestal of claim 1 wherein said pedestal has two vertically spaced pairs of shelf-supporting walls and a vertically spaced pair of urn-supporting shelves.

4. The cremation urn display pedestal of claim 3 wherein said base top wall is approximately 24 inches above a supporting floor surface, the lowermost one of said pair of urn-supporting shelves is approximately 40 inches above the supporting floor surface and the uppermost one of said pair of urn-supporting shelves is approximately 55 inches above the supporting floor surface.

5. The cremation urn display pedestal of claim 1 wherein said at least one urn-supporting shelf includes a light mounted centrally on the lower surface thereof for illuminating a cremation urn supported atop said base top wall.

6. The cremation urn display pedestal of claim 4 wherein said at least one urn-supporting shelf includes a side edge opposite each said shelf-supporting wall, each said side edge having a lip extending downwardly therefrom, said lips concealing said light when viewing said display pedestal.

7. The cremation urn display pedestal of claim 5 further including a dimmer switch in electrical communication between said light and a source of electrical current operable to selectively brighten and dim said light.

8. The cremation urn display pedestal of claim 1 wherein all said walls and said at least one urn-supporting shelf are fabricated from pressed wood particle board and wherein the exterior visible surfaces of said all walls and said at least one shelf are laminated with decorative vinyl sheet.

9. The cremation urn display pedestal of claim 1 wherein said top wall and said at least one urn-supporting shelf are square and are approximately 16 inches on a side.

10. The cremation urn display pedestal of claim 1 wherein said base top wall is approximately 24 inches above a supporting floor surface and said at least one urn-supporting shelf is approximately 40 inches above the supporting floor surface.

11. A decorative cremation urn display pedestal comprising:

a lower base configured into a generally box-like structure and including four generally vertical side walls having abutting adjacent side edges, and a generally horizontal cremation urn-supporting top wall supported atop said side walls;

a pair of shelf-supporting walls extending upwardly from said top wall and having abutting adjacent side edges, each wall of said pair of self-supporting walls being generally parallel to a respective base side wall thereunder; and at least one generally horizontal cremation urn-supporting shelf extending horizontally outward from said pair of shelf-supporting walls, said at least one shelf corresponding in size and shape to said base top wall and being cantilevered horizontally outward from said pair of shelf-supporting walls by having a free unsupported corner positioned above a respective corner of said base top wall;

wherein all said walls and said at least one urn-supporting shelf are secured together with hot melt glue, said base top wall is additionally secured to the upper edges of said base side walls with dowels and said at least one urn-supporting shelf is additionally secured to the upper edges of said shelf-supporting walls with the use of dowels.

12. A cremation urn display in a funeral home display area for offering for sale cremation urns to customers of the funeral home, said display comprising:

a decorative cremation urn display pedestal comprising:

a lower base configured into a generally box-like structure and including four generally vertical side walls having abutting adjacent side edges, and a generally horizontal cremation urn-supporting top wall supported atop said side walls;

a pair of shelf-supporting walls extending upwardly from said top wall and having abutting adjacent side edges, each wall of said pair of shelf-supporting walls being generally parallel to a respective base side wall thereunder; and a generally horizontal cremation urn-supporting shelf extending horizontally outward from said pair of shelf-supporting walls, said shelf corresponding in size and shape to said base top wall and being cantilevered horizontally outward from said pair of shelf-supporting walls by having a free unsupported corner positioned above a respective corner of said base top wall; and a pair of cremation urns, one of which is supported atop said top wall and the other of which is supported atop said shelf.

13. The cremation urn display of claim 12 wherein said cremation urn display pedestal has a pair of cremation urn-supporting shelves, each supporting a cremation urn, for a total of three cremation urns supported by said display pedestal, and wherein said display further comprises two additional cremation urn display pedestals of the type specified in claim 12, one of which is located on either side of said two-shelf pedestal, and each of which has a pair of cremation urns supported thereby, one on said top wall thereof and the other on said shelf thereof, for a total of seven cremation urns in said cremation urn display.

14. The cremation urn display of claim 13 further comprising a pair of box-like cremation urn display pedestals one of which is positioned forward of each said single-shelf cremation urn display pedestal and each of which comprises four generally vertical side walls having abutting adjacent edges and a generally horizontal cremation urn-supporting top wall supported atop said side walls, and each of which has a cremation urn supported on said top wall, for a total of nine cremation urns in said cremation urn display.

15. A decorative cremation urn display pedestal comprising:

a lower base including a pair of generally vertical side walls having abutting adjacent side edges, and a generally horizontal cremation urn-supporting top wall supported atop said side walls;

a pair of shelf-supporting walls extending upwardly from said top wall and having abutting adjacent side edges, each wall of said pair of shelf-supporting walls being generally parallel to a respective base side wall thereunder; and at least one generally horizontal cremation urn-supporting shelf extending horizontally outward from said pair of shelf-supporting walls, said at least one shelf being cantilevered horizontally outward from said pair of shelf-supporting walls and having a free unsupported portion positioned above and vertically aligned with a respective portion of said base top wall.

16. The cremation urn display pedestal of claim 15 wherein said base is square in cross-section having four said side walls, said base top is square and said at least one urn-supporting shelf is also square corresponding in size and shape to said base top wall, said urn-supporting shelf having a free unsupported corner positioned above a respective corner of said base top wall.

17. The cremation urn display pedestal of claim 15 wherein said shelf-supporting walls are recessed inwardly slightly relative to said base top wall and urn-supporting shelf and wherein said urn-supporting shelf is supported atop the upper edges of said shelf-supporting walls.

18. The cremation urn display pedestal of claim 17 wherein said pedestal has two vertically spaced pairs of shelf-supporting walls and a vertically spaced pair of urn-supporting shelves.

19. The cremation urn display pedestal of claim 18 wherein said at least one urn-supporting shelf includes a light mounted centrally on the lower surface thereof for illuminating a cremation urn supported atop said base top wall.

20. The cremation urn display pedestal of claim 19 wherein said at least one urn-supporting shelf includes a side edge opposite each said shelf-supporting wall, each said side edge having a lip extending downwardly therefrom, said lips concealing said light when viewing said display pedestal.

21. The cremation urn display pedestal of claim 20 further including a dimmer switch in electrical communication between said light and a source of electrical current operable to selectively brighten and dim said light.

* * * * *

UNITED STATES PATENT AND TRADEMARK OFFICE

CERTIFICATE OF CORRECTION

PATENT NO. : 5,709,441

DATED : January 20, 1998

INVENTOR(S) : Bart Bartling et al

It is certified that error appears in the above-identified patent and that said Letters Patent is hereby corrected as shown below:

Column 6, line 21, should read -- a pair of shelf-supporting walls --, not "a pair of shelf-supports walls."

Signed and Sealed this

Seventh Day of July, 1998

Bruce Lehman

*Attest:*

BRUCE LEHMAN

*Attesting Officer*

*Commissioner of Patents and Trademarks*